United States Patent [19]

Binczewski

[11] Patent Number: 4,567,936

[45] Date of Patent: Feb. 4, 1986

[54] COMPOSITE INGOT CASTING

[75] Inventor: George J. Binczewski, Moraga, Calif.

[73] Assignee: Kaiser Aluminum & Chemical Corporation, Oakland, Calif.

[21] Appl. No.: 641,908

[22] Filed: Aug. 20, 1984

[51] Int. Cl.[4] ..... B22D 11/16; B22D 11/00

[52] U.S. Cl. ..... 164/453; 164/461; 164/467; 164/487

[58] Field of Search ..... 164/415, 461, 467, 475, 164/503, 453, 486, 487

[56] References Cited

U.S. PATENT DOCUMENTS

| | | | |
|---|---|---|---|
| 2,055,980 | 9/1936 | Liebmann | 164/461 |
| 2,264,457 | 12/1941 | Roth | 164/98 |
| 2,983,972 | 5/1961 | Moritz | 164/420 |
| 3,206,808 | 9/1965 | Robinson | 164/461 |
| 3,353,934 | 11/1967 | Robinson | 428/636 |
| 3,368,607 | 2/1968 | Maddigan | 164/1 |
| 3,421,569 | 1/1969 | Neumann | 164/461 |
| 3,421,571 | 1/1969 | Webber et al. | 164/461 |
| 3,470,393 | 9/1969 | Moncorge | 310/306 |
| 3,498,832 | 3/1970 | Wilson | 428/428 |
| 3,605,865 | 9/1971 | Getselev | 164/467 |
| 4,213,558 | 7/1980 | Hirobe et al. | 228/176 |
| 4,248,630 | 2/1981 | Balmuth | 420/528 |

FOREIGN PATENT DOCUMENTS

| | | | |
|---|---|---|---|
| 88511 | 9/1983 | European Pat. Off. . | |
| 90583 | 10/1983 | European Pat. Off. . | |
| 844806 | 7/1952 | Fed. Rep. of Germany . | |
| 57-75256 | 5/1982 | Japan | 164/461 |
| 2115836 | 9/1983 | United Kingdom . | |
| 2121822 | 1/1984 | United Kingdom . | |
| 2127847 | 4/1984 | United Kingdom . | |

OTHER PUBLICATIONS

"Simultaneous Casting of Alloy Composites", Binczewski et al., *Proceedings of the AIME,* 1972, pp. 465–481.

"Handbuch des Stranggiessen", Hermann, pp. 277–280.

*Primary Examiner*—Nicholas P. Godici

*Assistant Examiner*—Richard K. Seidel

*Attorney, Agent, or Firm*—Malcolm McQuarrie

[57] ABSTRACT

A method and system for continuously or semicontinuously casting a composite metal article, such as a structurally composite ingot or the like, wherein one of the principal structural components of the ingot comprises an aluminum-lithium alloy. During such casting by a D.C. (direct chill) conventional tubular mold or electromagnetic process, the aluminum-lithium structural component of a structurally composite ingot is encircled or peripherally encased by a further outer metal cladding component that can be cast simultaneously with the aluminum-lithium component such as another outer aluminous alloy from which lithium is absent as a constituent or impurity, although it may be present and tolerated as a trace element. In this arrangement the aluminum-lithium structural component is prevented during casting from coming into direct contact with the chilling coolant, normally water, with which lithium can react violently. Only the outer aluminous alloy envelope is subjected to the direct contact of a liquid coolant whereby as it solidifies, this outer envelope or peripheral sheath acts as an impervious secondary mold for and protects the inner aluminum-lithium alloy structural component which is then directly controllably chilled and solidified.

6 Claims, 10 Drawing Figures

COMPOSITE INGOT CASTING

BACKGROUND OF THE INVENTION

This invention relates to the casting of metals. More particularly, it relates to the continuous or semicontinuous casting of aluminum-lithium alloys. Certain metals, such as aluminum alloys containing more than about 0.25% lithium, are highly reactive when exposed to certain environments. Lithium metal being an alkali metal, reacts vigorously with water such as in a DC permanent fixed mold type or electromagnetic type continuous or semicontinuous casting operation and where the lithium metal is in a molten state. Aluminum-lithium alloys present other unusual problems such as oxidation at elevated temperatures in the solid or liquid state. This means that potentially serious explosion hazards are present when the aforesaid casting procedures are employed with aluminum-lithium alloys. Explosive reactions involve great releases of energy and potentially severe damage to equipment and injuries to personnel.

While these dangerous conditions can be controlled through the use of expensive equipment and processes including inert gases, oxygen free atmospheres, and vacuum induction melting furnaces that afford controlled atmospheres and environments, the costs have been prohibitive or excessively high. Thus these explosive hazards and cost problems have hampered and delayed the large-scale commercial production and exploitation of aluminum-lithium alloys despite the many advantages of the same in finished product applications. One of the most desirable applications for aluminum-lithium alloys involves aircraft components because of a lower density and higher modulus than the standard high-strength heat-treatable aluminum alloys that are presently available.

The nature of the DC tubular fixed mold and/or electromagnetic casting processes requires precise control of the many elements involved, such as mold type; casting or drop rate; mold lubricant; ingot size; liquid or molten metal distribution within the confines of the mold; water quantity and temperature; and liquid metal heights within the mold. When control of one or more of these variables is interfered with or lost during a casting operation, various problems, such as "bleedouts", can occur. A "bleedout" is a phenomenon wherein a flow of molten metal takes place along an already solidified outer surface of an ingot much in the same fashion as the wax flows down the side of a candle. As indicated in U.S. Pat. No. 2,983,972, a "bleedout" can be the result of a localized remelting through the initially thin-chilled wall of the solidifying ingot caused by the heat of the hot molten metal in the inside of the ingot probably under the influence of pressure from the hydrostatic head of molten metal at the top of the ingot. If a "bleedout" occurs, hot liquid metal will come into direct contact with the usual water cooling medium. When aluminum-lithium alloys are involved, the result can be explosively dangerous and disastrous. The loss of electrical power or a disruption of the coolant water pattern on the mold and/or ingot at the casting stations presents "bleedout" opportunities. Further complicating the control elements and the propensity for "bleedouts" to occur is when the alloy being cast has a relatively low solidus line temperature, which is approximately 900° F. (482.2° C.) for the highly alloyed lithium-containing aluminum alloys.

Accordingly, it is a primary purpose of this invention to provide improved processes and systems for continuously or semicontinuously casting lithium-containing alloys selected from the group consisting of aluminum and the alloys thereof, and wherein lithium is one of the constituents and preferably a major constituent. For the purposes of this invention, a clad cast lithium alloy as described and claimed herein shall be a metal alloy, and preferably, an aluminum alloy containing more than about 0.25% lithium as a constituent along with the usual impurities.

Examples of the types of aluminum-lithium alloys that may be clad cast by the processes and systems of the invention are those described in European Patent Application Nos. 090,583 and 088,511 and United Kingdom Patent Application Nos. 2,115,836A, 2,127,847 and 2,121,822A. A further aluminum-lithium alloy could be one containing up to 2.5% Li; 1.2% Cu; 0.7% Mg; 0.12% Zr and the balance aluminum.

It is a further purpose of this invention to cast in a substantially continuous or semicontinuous fashion aluminum-lithium-containing alloys within a precast solid metal shell, and preferably an aluminum alloy shell having a higher solidus line temperature than that of the aluminum-lithium alloy in order to prevent direct contact between the aluminum-lithium alloy and the coolant and thus avoid occurrence of a "bleedout" of the encircled or encased aluminum-lithium alloy. In effect, the aluminum-lithium alloy is cast within an outer protective aluminum mold or shell with the coolant medium being applied directly to the outer aluminum mold. The resultant product is a structurally sound and composite ingot, billet or like article made up of a first metal structural component or core material, i.e., the aluminum-lithium alloy and a second metal structural component which is the protective outer metal shell or mold, preferably in the form of an aluminum alloy such as an aluminum alloy of the 1000 series as designated by the Aluminum Association in the United States from which lithium is absent as a constituent or usual impurity although it may be tolerated as a trace element.

Another attribute of this improved casting system and method is the uniqueness of continuously casting the outer protective mold itself substantially simultaneously with the encased aluminum-lithium alloy core. This permits more precise control of various metallurgical conditions while providing savings in time, equipment, and personnel. For example, this allows a simultaneous spreading or wetting by the liquid portion of the core alloy of the inner surface of the solid mold or outer alloy and a continuous and integral metallurgical interface and bonding therebetween throughout substantially the entire casting operation. This in turn means that the desirable heat transfer features of the direct chill process for both the core material and outer alloy mold will be retained while the core alloy solidifies.

In a further advantageous embodiment of the invention and in order to compensate for thermal contraction or shrinkage of the outer cladding material and mold and yet ensure free movement or passage of the cladding out of the main mold unit to form in and of itself a fully solidified combination cladding and casting mold of the desired and substantially uniform cross-sectional thickness or width at the plane or point of initial contact between molten metal core and outer metal cladding mold, components of the main casting mold can be somewhat tapered to provide a somewhat larger mold space in cross section at the exit end thereof.

The improved process and system advantageously allow the subsequent fabrication and processing of the final composite or metal clad ingot or encased article by way of conventional rolling, extruding, and forging equipment, etc. It is well known and as indicated in the aforesaid United Kingdom Patent Application No. 2,121,822A, that elevated temperatures such as occur during homogenizing, annealing, solution heat treating, and hotworking, can have serious detrimental effects relative to the surface of aluminum-lithium alloys because of the oxidation activity and lithium losses due to such oxidation.

In the past, where lithium alloys were handled, it was usually necessary to have controlled atmospheres where oxygen and water vapor were excluded by appropriate enclosures such as are indicated in U.S. Pat. Nos. 3,498,832, 3,368,607 and 4,248,630. With the composite or clad alloy ingot obtainable by practice of the invention, a protective environment is not needed as the ingot exits the segmented or dual mold of the instant invention. The clad product in effect carries its own protective environment by way of the cladding. On the other hand, in those instances where the cladding material resulting from the casting operation is not desired in the final product but only the aluminum-lithium core alloy itself, the cladding can be readily removed by standard scalping or cutting tools, sanding, or chemical etching.

Additional features of the improved casting process and system of the instant invention involve the unique metallurgical bonding occurring between the mold and core alloy whereby the properties of a wrought-type product can be obtained, plus the ability to reduce or eliminate the cracking propensity of many alloys, especially the more highly alloyed, solution heat-treatable-type alloys involving lithium as a constituent. The precast solid aluminum shell forming the outer common casting mold and cladding of the final product advantageously retards the thermal shock incurred when such alloys are cast in the conventional DC casting operations using either a fixed mold or electromagnetic equipment. This thermal shock affects both the physical changes that take place during solidification, such as the 6% to 8% volumetric change, as well as the changes associated with a simultaneous solution heat-treat effect, as the metal moves from the liquid to solid phase and a rapid chilling of the casting takes place. In the past, this superimposition of the physical and metallurgical changes or phenomena created enormous stress areas in an ingot which often resulted in spontaneous stress relief by the physical cracking during casting or later rolling and ultimate scrapping of the ingot products. It is to be further understood that in the practice of the invention, the size and shape of a given ingot, as well as the thickness of a given cladding, plus the speed of casting, i.e., drop rates, coolant and contraction rates, etc., will all depend on the specific results and products desired, provided, of course, the cladding is sufficiently solidified and of sufficient thickness at the point or plane of initial and subsequent cladding and core contact to withstand the metal head and pressures of the molten metal core.

Although as noted the thickness of the cladding material will vary with individual requirements for the structurally composite ingots one preferred embodiment of the invention contemplates that the present specificiations for alclad sheet and plate be used. Accordingly, the cladding thickness can range from 1.5% to 5%± casting tolerances of the total ingot thickness per side for a non circular ingot or of the diameter for a circular ingot or billet. Thus, if a rectangular in cross section ingot has an overall thickness of 20" (50.80 cm) each side cladding should be between 0.3" (0.762 cm) and 1" (2.54 cm) in the case of a billet 20" (50.80 cm) in diameter between 0.3" (0.762 cm) and 1" (2.54 cm).

Various schemes have been proposed in the past involving continuous or semicontinuously direct chill or DC tubular mold or similar casting operations for producing clad and composite ingots, billets, or like articles, including those made from aluminum alloys, as indicated, for example, in U.S. Pat. Nos. 3,206,808, 3,353,934, 3,421,569, 2,055,980, 3,421,571 and 4,213,558. Further, prior art segmented or multiple mold clad casting equipment is disclosed in U.S. Pat. No. 2,264,457, German Pat. No. 844,806, and at pages 277–280 of the Handbook of Casting by Dr. Erhard Herrman (Handbuch des Stranggeissen), Copyright 1958 by Aluminium-Verlag GmbH. None of these patents, however, as well as the literature reference, recognizes the advantages or concepts of such practices as applied to the economical large-scale production of aluminum-lithium alloys.

One final observation is believed to be in order regarding prior art continuous clad casting processes such as is disclosed in U.S. Pat. No. 3,470,393, wherein a cladding material is cast about a solid core prior to reviewing the details of the instant process and system. The instant development proposes a basically reverse-type concept in that it contemplates solidifying the cladding metal first rather than the core metal so that the cladding can advantageously form a solid outer impervious tubular casting mold or envelope that can be filled with a molten aluminum-lithium alloy and not vice versa.

In the claims and detailed description of the invention which is to follow, the term "tubular cladding and casting mold" is meant to cover a combination outer protective sheath or envelope and mold for an inner metal core containing lithium wherein the metal core is in intimate metallurgical contact with the aforesaid outer cladding sheath. The combination cladding and moving casting mold is preferably formed by direct chill or DC casting using a fixed or permanent tubular mold, assembly or an electromagnetic inductor and appropriate associated mold elements. While the ensuing discussion of the various embodiments of the invention will be directed to DC casting operations of the aforesaid types it is believed that the teachings of the invention can be extended to rotating casting wheels and cooperating belt means or a pair of moving cooperating belts. The term "tubular" is meant to include any shape that had an endless geometric outer surface or peripheral configuration in cross section. Thus, the basic casting mold arrangement for the final product can be circular, rectangular, square, elliptical, hexagonal, etc.

BRIEF DISCUSSION OF THE DRAWINGS

DETAILED DESCRIPTION OF THE INVENTION

Figure 1:
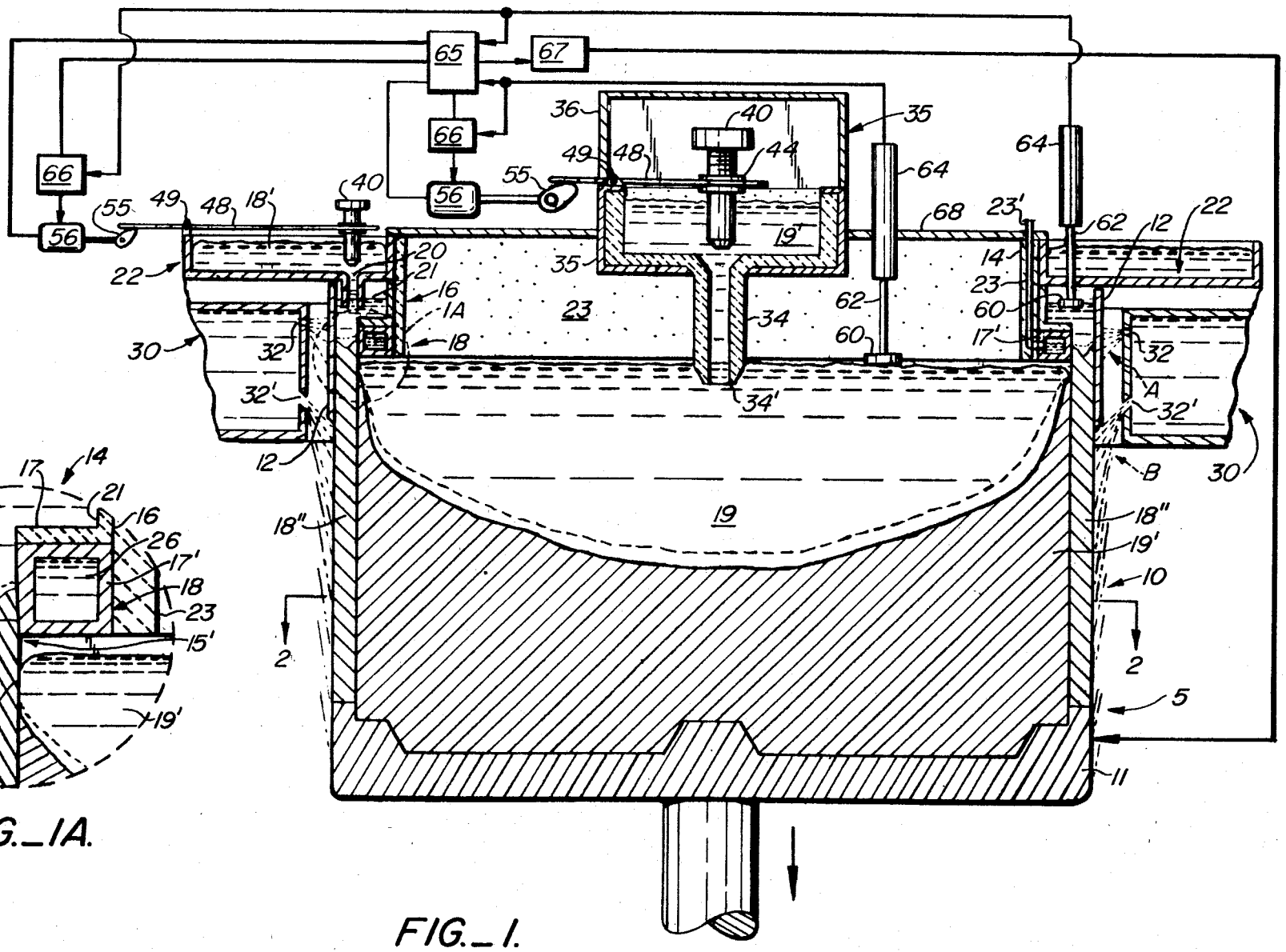
FIG. 1 is an elevational broken cross-sectional view with parts removed and other parts broken away of a direct chill casting station provided with a segmented or plural tubular casting mold assembly which can be used in practicing the process and system of the instant invention and with certain elements of a suitable metal flow control system also being schematically shown.

With further reference to the drawings and in particular FIG. 1, the segmented tubular rectangular casting mold assembly 10 is comprised of the standard bottom block unit 11 operated by the usual means (not shown) for receiving the embryonic portions of the structurally composite ingot 5 and an outer continuous fixed mold shell 12 made from a suitable material, such as steel, silicon carbide, graphite, or "Marinite" (Marinite being a Johns-Manville trademark designation for a lightweight fibrous refractory (Magnesium silicate)). Located interiorly of and in spaced relationship to the outer mold shell 12 is a cooperating cross-sectionally stepped and rectangular in plan interior combination water jacket and mold assembly 14 dependingly secured to a molten metal reservoir 22 in a manner well known in the art. Mold and jacket assembly 14 includes an upstanding baffle wall portion 16 and a stepped seat portion 17 and water jacket 17'. As indicated particularly in FIG. 1A the wall surfaces 15 and 21 of wall portion 16 and water jacket 17', respectively, act in conjunction with the wall surface 21' of mold shell 12 to form a hot top distributor or tubular cladding mold 18 for the molten metal 18' which is transformed into the cladding 18'', said metal 18' being preferably an aluminum alloy such as one in the 1000 series type having a higher solidus line temperature than that of the core alloy 19 that includes lithium as a constituent. Wall 16 and jacket 17' can be advantageous lined with a suitable refractory lining 23 having passageways and openings for conducting coolant in and out of chamber 26 in jacket 17'. Wall 15 of water jacket 17' can be slightly tapered or inclined by one or more degrees in the bottom area to provide a widened exit end 15' for mold 18 whereby as the cladding 18'' shrinks inwardly upon solidifying, it will not bind on jacket 17'. The walls of mold shell 12 and jacket 17' can also be continuously lubricated with a suitable lubricant, e.g., castor oil, by means (not shown) in a manner well known in the art.

The means for supplying molten metal to unit 18 to form cladding mold 18' comprises a pouring spout 20 of suitable refractory material that leads to a further elevated molten metal reservoir 22 also made of a suitable refractory material. Molten metal can be held in the reservoir at about 1300° F. (704.4° C.). The entrance to spout 20 from secondary reservoir 22 is controlled by means of a suitable flow control valve mechanism 40 to be described. The interior of jacket and mold assembly 14 may be cooled by way of a liquid coolant, such as water, circulated within the jacket chamber 26. Coolant can enter and exit from chamber 26 by way of passages or piping 23' in lining 23. This coolant acts to chill the molding surface 15 of assembly 14. Located in spaced relationship to the jacket and mold assembly 14 and the outer surface of mold shell 12 is a water coolant spray box 30. Spray box 30 surrounds the entire outer rectangular mold shell 12 in the usual fashion and contains a plurality of appropriate upper and lower apertures 32 and 32', respectively, for discharging the usual coolant water peripherally in a fashion well known in the art firstly onto the outer mold shell 12 and then just below the lower terminal edge of mold shell 12 and directly on the outer surface of the emerging solidified cladding shell 18''.

Figure 1A:
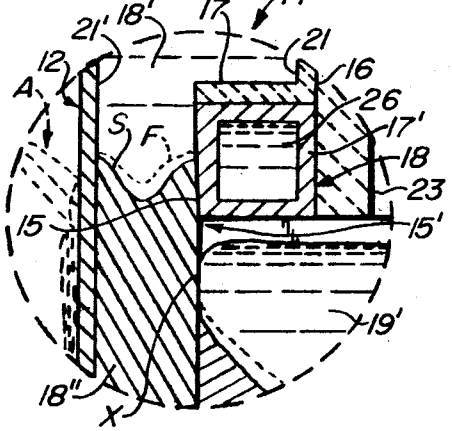
FIG. 1A is an enlarged view of a section of FIG. 1 taken within the circumscribing circle 1A thereof.
Figure 1B:
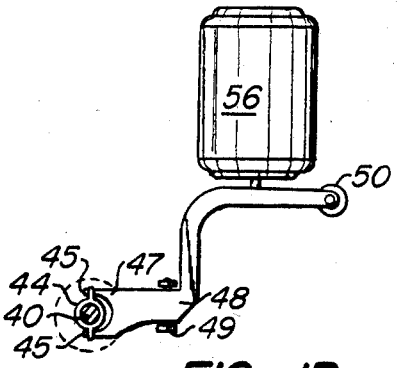
FIGS. 1B–1C are additional views of certain of the elements making up the metal flow control system of FIG. 1.

The chilling action of the coolant in chamber 26 first upon the molding surface 15 of mold assembly 14, and then the portions of molten metal 18' in contact therewith, plus the chilling action of the coolant emerging from spray box 30 first upon the surfaces of mold shell 12 and then through conductive action upon the portions of molten metal 18' in contact therewith initiates the freezing and subsequent solidification of the molten metal making up the final cladding 18'' at about the cooling level A in the area of the top spray apertures 32 all as indicated in FIG. 1A. Further direct heat transfer is effected by contact of coolant spray and cladding shell 18'' at about the second cooling level B where water from lower spray apertures 32' now contact the cladding shell 18'' as it emerges from the mold unit 18. From the above, it will be seen that freezing and solidification of the cladding mold shell 18'' will be initiated generally at the upper level A in the casting station followed by complete or full solidification remote from and preferably well above the second level B, level B being still high enough up in the casting station whereby a sound and solid combination cladding and clad metal mold 18'' will be produced well before initial contact of the cladding 18'' with the molten portion of core ingot material 19. After solidification of the initial portion of mold 18'' is effected further solidification can then continue uninterruptedly both as to the succeeding portions of cladding mold 18'' and core ingot material 19 until a final structurally composite ingot 5 of the desired length is cast.

As further indicated in FIGS. 1 and 1A, the core ingot material 19 of aluminum lithium metal is introduced into moving cladding mold 18'' by way of a submerged pouring spout 34 dependingly secured to a refractory lined reservoir 35 where the metal can also be held at about 1300° F. (704.4° C). In a preferred embodiment of the invention the terminal opening 34' of the reservoir spout is located at a point well below the level F of initial freezing and the solidus line or solidification level S of the material making up the cladding mold 18''. Thus, by the time the molten material 19 for core 19′ makes contact at about level X with the combined cladding and tubular mold 18′, mold 18″ will be a strong solid impervious structure. Reservoir 35 containing the molten aluminum lithium alloy metal is advantageously enclosed by cover 36 to provide a sealed container for the alloy metal. An inert gas, such as argon, can also be maintained in the covered reservoir 35 to prevent oxidation of the molten metal in a manner well known in the art and molten aluminum metal and the lithium constituent of the alloy metal can be introduced into reservoir 35 in any appropriate fashion to avoid or minimize loss by oxidation. As noted above, the movable bottom block assembly 11 acts as a platen for the structurally composite ingot and is movable downwardly at a selected rate as the ingot continues to be formed in a manner well known in the art until such time as the casting of the structurally composite ingot has been completed. In the completed product which can be further processed as a structurally composite ingot, the core metal containing lithium as a constituent can be considered as a first structural component of the finally cast structurally composite ingot while the outer protective cladding 18″ constituting the hollow tubular mold for the final solidified core 19′ can be regarded as a second structural component.

Figure 1D:
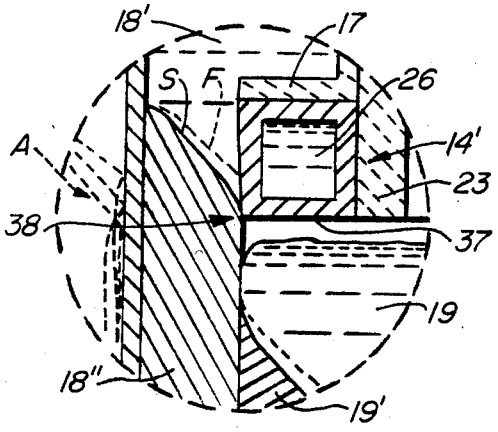
FIG. 1D is a view similar to FIG. 1A and illustrates a further embodiment of the instant invention.

In those instances where by design or accident, mold and jacket assembly 14 is not cooled interiorly by coolant in chamber 26 as in FIGS. 1 and 1A this assembly can still as indicated in FIG. 1D advantageously act or function as a metal restraining baffle 14′. In these latter situations, the solidus line S will no longer assume the cup shape of FIG. 1A because the cooling and solidification of the metal 18′ will be primarily effected by outer mold shell 12 and the coolant from spray box 30. Thus the solidus line S will assume the inwardly downwardly inclined shape or direction of FIG. 1D. In any event, the metal 18′ forming cladding 18″ will still be substantially fully solidified across its width or for its full thickness as it clears the bottom 37 of baffle 14′ at about the level 38 and prior to contact with the molten core metal 19′ containing lithium.

The manner in which the elevated level of the molten material 18′ for cladding 18″ is established and maintained in mold 18 relative to the lower level of the molten material making up core 19 whereby the molten core material 19 will initially contact the cladding in the form of a fully solidified outer cladding mold 18″ at a safe level X will now be described. This molten metal control can be of the type shown and described in copending U.S. patent application Ser. No. 266,788 filed 5/26/81, Takeda et al inventors.

Figure 1C:
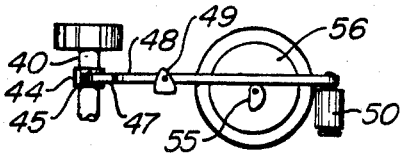

With further reference to the drawings and particularly FIGS. 1–1C pouring spouts 20 and 34 for reservoirs 22 and 35 are each provided with a flow control pin 40. Flow control pin 40 is threaded so it can be adjustably held in a correspondingly threaded collar 44. Arms 45 on collar 44 are held and seated in recesses in a bifurcated yoke 47. Yoke 47 can be formed as one terminal part of lever arm 48 which is suitably pivoted by pin means in the support brackets 49 mounted on a reservoir wall so that upon rotation of arm 48, the flow control pin 40 can be raised or lowered, thereby regulating the flow of molten metal as required through the spout 20 or 34 as the case may be. The other terminal end of lever 48 which may have a somewhat dog leg configuration in plan can be provided with a balancing weight 50. The pivotal movement of a lever arm 48 and the raising or lowering of a pin 40 is effected by rotation of a suitably configured cam 55 driven by a reversible motor or rotary actuator 56 in response to a suitable control signal from a signal generating system to be described.

Cam 55 preferably has the shape of an Archimedes spiral of an appropriate size and because of its particular configuration or shape, each unit or degree of angular rotation of the cam 55 will provide an equal unit or amount of linear displacement of the lever arm 48 in contact with the operating surface of the cam 55 and ultimately the desired up or down movement of a given flow control pin 40 controlled by a given arm 48. The angular rotation of a given control cam 55 by rotary reversible actuator or motor 56 is directly proportional to a signal representing the deviation of the actual molten metal level in the mold 18 for the cladding metal 18′ or the level of the molten portion of the core metal 19 as the case may be from the particular predetermined levels desired and programmed into a controller 65 to be described. A suitable motor or actuator 56 is one of the type produced and sold by Foxboro-Jordan, Inc., Milwaukee, Wis., under Model No. SM-1180 and a Foxboro-Jordan amplifier Mode AD 7530 can be included.

As further indicated in the aforementioned patent application and FIGS. 1–1C of the drawings, continuous sensing of the metal levels in each casting mold operation, e.g., at the head of the molten cladding material 18′ and at the head of molten portion 19 of core metal 19′ is accomplished by means of a float 60 operatively connected by way of a rod 62 and other elements (not shown) to a linear displacement transducer 64. The displacement transducer can have a range of several inches and a suitable transducer is Model 2000 HPA sold by the Schaevitz Corporation, New York, N.Y. Although the level sensing and signal generating unit is primarily described as a float mechanism operatively connected to a linear displacement transducer, other signal generating equipment could be utilized.

The overall control system which synchronizes and ties together operation of the individual control pins 40 in the two molten metal reservoirs 22 and 35 includes a master or supervisory controller 65. Controller 65 is advantageously programmed to provide directions and molten metal level setpoint signals to the local controllers 66 associated with the individual casting metal reservoirs 22 and 35. Each of the local controllers 66 continuously monitors and compares the signal representing the respective condition sensed, i.e., the molten metal level actually sensed for cladding metal 18′ in mold assembly 18 or the molten head of core metal 19 as the case may be with a predetermined setting signal from the master controller 65. Controller 65 is programmed to provide a control signal that represents the predetermined difference in the molten metal levels between the head of core metal 19 and the level or head of metal 18′ in mold assembly 18 whereby through controlled metal feeding the molten core material 19 will contact only fully solidified cladding metal 18′ as the succeeding sections of the composite ingot are progressively formed. Upon comparison of the signals and recognitions of any undesirable deviation, a local controller 66 will respond substantially immediately to effect the corrective action required in a given situation by raising or lowering the particular flow control pin 40 it controls.

Programming of master controller 65 as aforementioned can also include a preselected drop rate setting for bottom block assembly 11 through the further controller 67 shown in FIG. 1 in a well-known manner, said drop rate in turn being further coordinated with the preselected heat transfer rates for the individual structurally composite ingots being cast. A suitable control unit for the master controller 65 is Model 484, Modicon Controller, sold by the Gould Company, Modicon Division, Andover, Mass. Suitable local controllers 66 can be of a type that are sold under the name Electromax III, by the Lees & Northrup Company, North Wales, Pa. For further details on how the control system may be adjusted, reference is made to the aforementioned copending patent application U.S. Ser. No. 266,788.

In a further advantageous embodiment of the invention, since handling of lithium-containing aluminum alloys in the molten condition, as well as other conditions, is troublesome because of oxidation loss and hydrogen pickup problems, it is contemplated that the top of the trough and spout, and, in effect, the entire upper part of the tubular mold assembly 10 for core 19′ would be housed or enclosed by means of a covering or shroud 68. In this way, the material forming the ingot core 19′ can be maintained in a closed chamber and inert atmosphere wherein a nonreactive inert gas, such as argon or the like, can be fed to prevent oxidation and in turn a possible explosive condition similar to the situation as regards reservoir 35.

Figure 2:
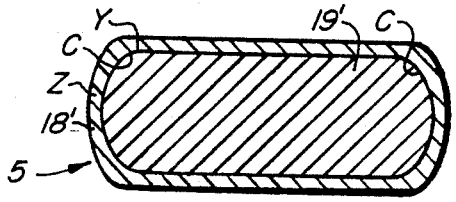
FIG. 2 is a cross-sectional view taken along line 2—2 of FIG. 1 and illustrates the general rectangular configuration of the composite ingot being cast.

With particular reference to FIG. 2 which is a cross-sectional view of the ingot being cast in FIG. 1, it will be noted that various sections of the wall surfaces 15 and 21′ can be so configured and spaced from each other in the case of a rectangular cladding mold unit 18″ that the cladding of the ingot 5 will be somewhat thickened in the corners C vis-a-vis the sides Y and ends Z. This corner thickening is to compensate for the faster and more pronounced cooling and solidification of the ingot in the corners C than along the sides and ends whereby substantially all portions of the cladding material 18′ in said ends and sides as they exit at the same level from the terminal end 15′ of the overall mold unit 18 will have a substantially uniform and full solidification in cross section at various levels on the ingot.

Figure 3:
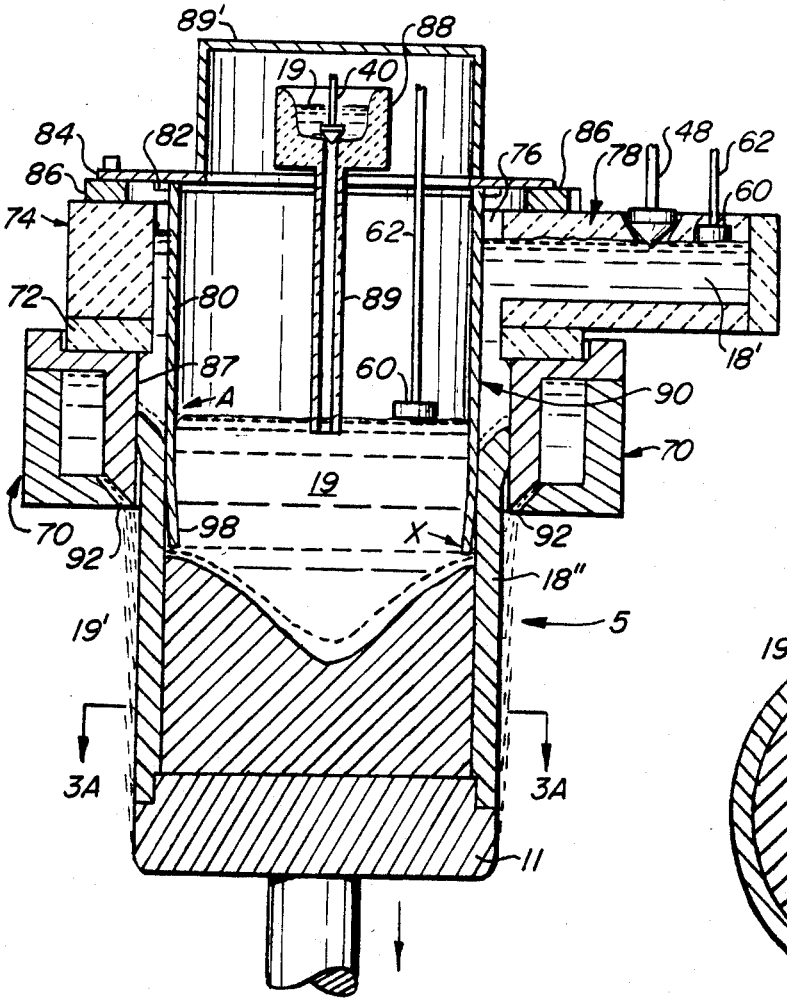
FIG. 3 is a view similar to FIG. 1 and discloses an alternate type of cooling system or cooling means for a casting station provided with a segmented tubular casting mold, as well as a different mode of feeding the molten metals making up the various components of the composite ingot to the casting station.
Figure 3A:
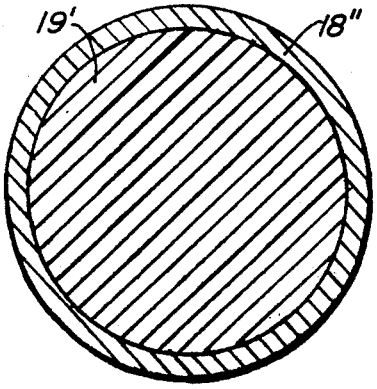
FIG. 3A is a cross-sectional view taken along line 3A—3A of FIG. 3.

FIG. 3 discloses a further type of tubular mold assembly for carrying out the teachings of the invention. In this instance, the casting station can comprise a level feed reservoir top assembly provided with a tubular mold and water jacket 70 surmounted by a lubricant control ring 72 and a molten metal reservoir 74, which is breached or opened at a selected location 76 in order to allow access thereto of the molten metal for cladding alloy 18′ by way of a suitable feed trough 78. Reservoir 74, along with trough 78, are fabricated from appropriate refractory material. Concentrically positioned within the reservoir 72 is a mold separator 80 which can be made of the same mold materials previously mentioned, such as steel, silicon carbide, etc. Mold separator 80 which acts further as a pouring spout for the molten core material 19 is welded to a suitable mounting plate member 82. Plate member 82 is bolted or otherwise affixed to a cover plate 84 and cover plate 84 is supported by a collar 86. Molten core material 19 is delivered by way of a covered refractory trough 88 provided with an elongated pouring spout 89. A cover or shroud 89′ protects and seals off metal 19 from the atmosphere. The same flow control system used for synchronizing the flow of core and cladding metal materials in the station of FIG. 1 can be used for that of FIG. 3. Thus, metal level sensing floats 60 and flow control plugs 40 of the type shown in FIGS. 1–1C can also be used to control the levels of the molten core metal 19 in mold separator 80 and the molten metal for cladding 18′ in mold reservoir 74.

The interior wall 87 of the mold and jacket 70 operates in conjunction with the shell 80 to form an upper tubular mold unit or segment 90 for the cladding metal 18′ which as previously discussed is preferably an aluminum alloy. Coolant from the mold jacketing ports 92 first effects an indirect heat transfer in the area of higher elevations on mold and jacket 70 and molten metal cladding 18′ so as to initiate freezing and then solidification of the metal 18′ for cladding 18″ while maintaining uniformity in cross-sectional thickness of the cladding about the entire periphery thereof. The walls of mold separator 80 and jacketing 90 can as in the case of the casting station of FIG. 1 be lubricated with a suitable lubricant by means well known in the art and not shown. The solidification continues as the various successive portions of metal for cladding 18′ move downward until they emerge from the bottom of jacketing and mold 70 and into direct contact with the coolant flowing from the spray holes 92 in the jacketing 70. As in the case of the structurally composite ingot of FIG. 1, the cladding 18′ generally solidifies at about the level A and well above initial contact with the molten metal core metal 19 at about level X.

Unlike the casting station of FIG. 1, there are no upper water discharge apertures in the jacketing. Thus, solidification of final cladding 18″ starts as the cladding metal 18′ is initially chilled by indirect heat transfer and through a contact with the combination jacketing and mold 70. Thereafter, final solidification is accelerated in the cladding metal 18′ somewhat upstream from the area of contact with coolant from the lower spray openings 92 and a substantial distance upstream from core and cladding metal contact at the level X.

In any event, the molten material of core 19 emerges from the separator mold 80 a slight distance below the area of contact of cladding 18″ and coolant in order that the cladding will be fully solidified prior to cladding contact with the molten core, so as to avoid "bleedout" problems. The inner core material starts to freeze or solidify about its periphery immediately upon contact with solidified cladding 18″ and while maintaining the usual interior molten crater of some depth. The depth of this core crater, as well as that of the cladding crater, can be controlled by the drop rate in a manner well known in the art. The same applies to the ingot crater components of FIG. 1. As in the case of the mold assembly of FIG. 1, the lower section 98 of mold and separator 80 can be tapered slightly inwardly and downwardly in a somewhat inverted frustoconical fashion to provide a somewhat oversized opening at the bottom to compensate for thermal contraction or inner peripheral shrinkage of the ingot cladding 18″.

Figure 4:
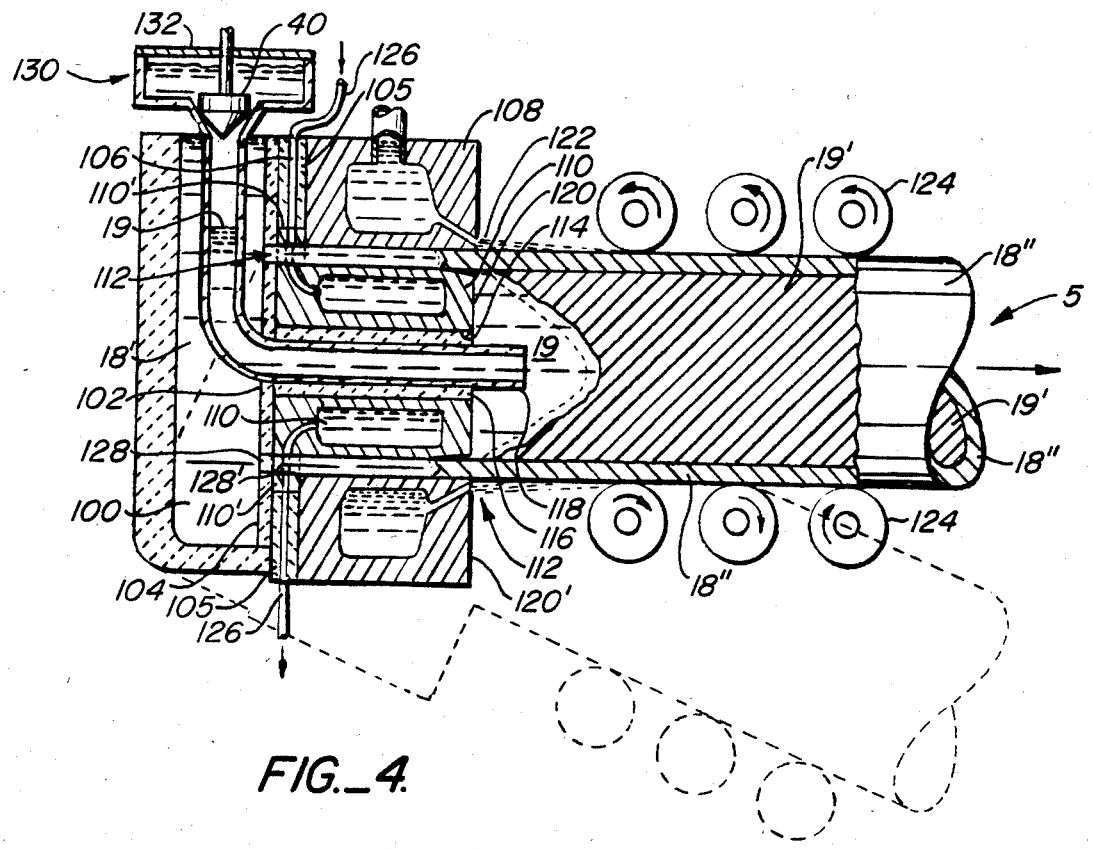
FIG. 4 is an elevational cross-sectional view of a continuous or semicontinuous horizontal casting apparatus that can be provided with a segmented tubular casting mold for use in practicing the instant invention.

FIG. 4 discloses a further embodiment of the invention in the form of a horizontal continuous or semicontinuous direct chill fixed mold assembly that can be used to practice the instant invention. This horizontal mold is comprised of a refractory metal reservoir 100 provided with an opening 102. Inner lining wall 104 for reservoir 100 is affixed to a hollow refractory stem 116 that is suitably anchored in opening 102. Located adjacent wall 104 are a pair of tubular and concentrically arranged and spaced combination mold and water jackets 108 and 110. Water jacket 110 can have a flanged end 110′ that fits in between outer jacket and lining 102. In other words, the inner and outer jackets form a tubular molding zone 112 therebetween of the desired cross-sectional shape, e.g., circular. Inner jacket 110 contains an elongated central bore or opening 114 for refractory stem 116 through which one segment of the elbow-shaped molten metal pouring spout 118 for the core metal can be inserted so as to project a predetermined distance downstream from the end 120 of the inner mold member and water jacket 110 and the end 120' of the outer water jacket and mold member 108. Jacket 108 is provided with appropriate coolant spray openings 122 through which water can be directed upon the emerging solidified cladding 18'', the solidification of this cladding 18'' having been initiated a substantial distance upstream from the coolant jacket spray openings 122 through the conduction contact with cooled mold jackets 108 and 110. Thus, solidification of cladding 18'' will be well completed before initial contact with molten core metal 19. The horizontal casting station of FIG. 4 is provided with the usual roller elements 124 for use in moving the composite ingot away from the casting station. Appropriate piping 126 directs water into and out of the interior water jacket 110 and through various refractory wall backup elements 105 of reservoir 100. Inner lining 102 and flanged end 110' of inner mold and jacket 110 contain an appropriate number of communicating radially disposed bores 128 and 128' for interconnecting the molding zone 112 with the interior of cladding metal reservoir 100 whereby molten metal 18' can be fed or passed from reservoir 100 to zone 112. In any event as noted above, the tip of the pouring spout 118 is located sufficiently downstream from the end walls of the various water jackets 108 and 110 whereby the introduction of molten core material 19 will be somewhat downstream from the initial solidification of the cladding metal 18' forming the outer mold. This means that the cladding 18'' again will always be substantially completely solidified prior to initial contact with the molten metal of the core. If desired, the entire casting station may be structured so that it can be somewhat tilted during casting in a manner well known in the art as shown in dotted lines in FIG. 4 to facilitate the overall casting operation. Although not shown or discussed, the metal flow control system as shown and described with reference to FIGS. 1–1C may also be used with the horizontal casting unit. Reservoir 130 for core metal 19 can also be enclosed by a covering 132 to preclude oxidation loss problems.

Figure 5:
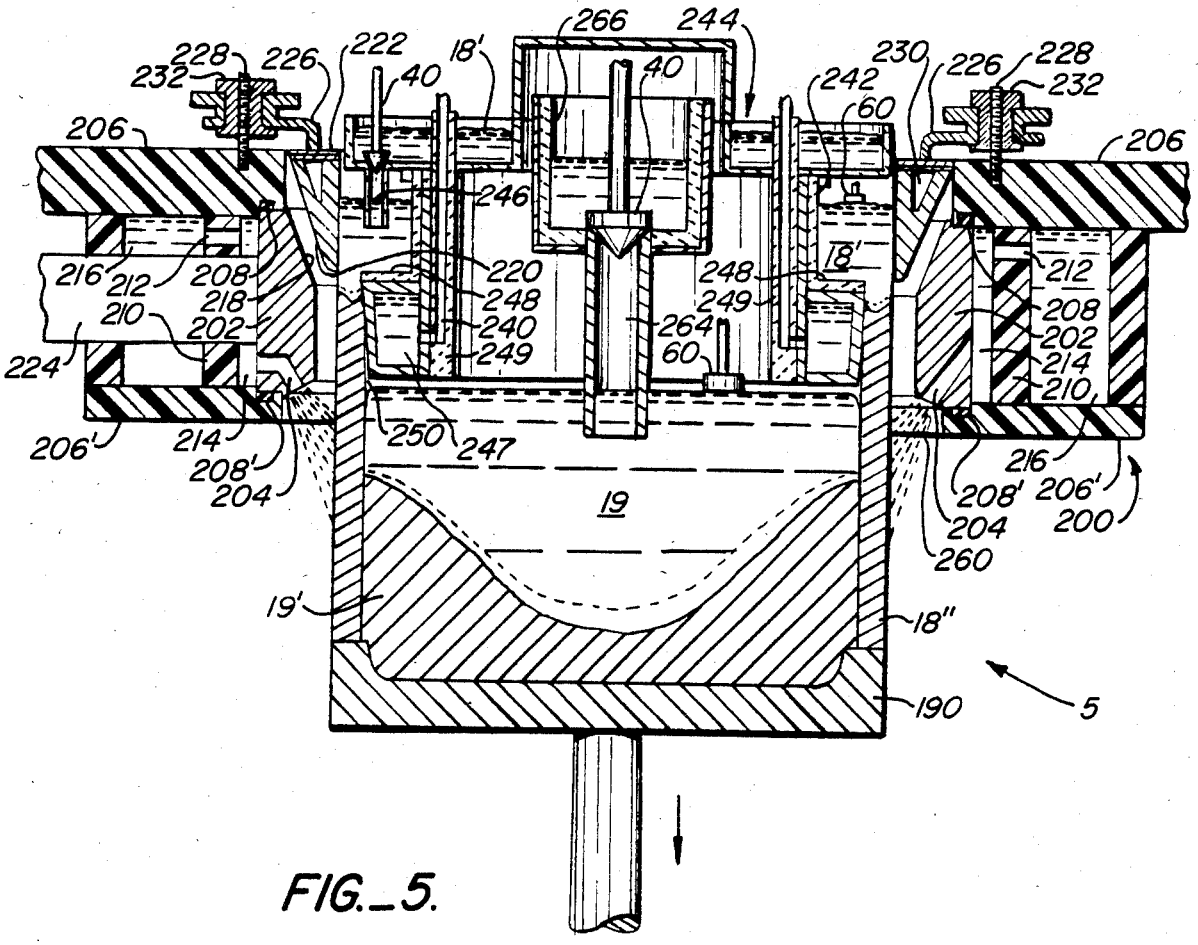
FIG. 5 is an elevational sectional view of an electromagnetic casting station with parts removed and other parts broken away.

Another embodiment of the invention is illustrated in FIG. 5 which discloses a typical electromagnetic casting station of the type shown by U.S. Pat. No. 3,985,179 and modified as noted hereinafter to practice the teachings of the instant invention and simultaneously cast sections of structurally composite ingots. The casting station of FIG. 5 can be used to produce a structurally composite ingot of the cross-sectional shape of FIG. 2, as well as other geometrical shapes in cross section. It includes the usual bottom block assembly 190 and means for operating the same (not shown) an outer coolant jacket and inductor assembly 200 containing an inductor 202 of the usual highly conductive materials, etc., and the shape of the ingot to be cast as the innermost wall of assembly 200. Inductor 202 is equipped with the conventional coolant spray passages 204, which can be modified for electrical wiring where necessary for directing water or other coolant onto the surface of the solidifying cladding 18'' forming the combined cladding and mold for core 19. Inductor 202 is fixed in sealed relationship between top and bottom plates 206 and 206' by way of the usual gaskets 208 and 208'. An upstanding baffle or partition wall member 210 containing coolant passages 212 defines in combination with plates 206 and 206' a coolant chamber or reservoir 214 interconnected with a further main coolant chamber 216 by way of the passages 212, chamber 216 in turn being connected to the main source of coolant (not shown). All of the elements making up the coolant jacket should be of nonmetallic and nonconducting material, such as laminated sheets of epoxy bonded fiberglass, polyvinyl chloride, etc.

The upper ingot facing surface 218 of inductor 202 is inclined away from the vertical axis of the casting assembly toward the top of the inductor to reduce the electromagnetic forces on the upper portion of the molten metal. The vertically inclined outer surface 220 of an electromagnetic watercooled shield 222 of nonmagnetic, high resistivity material, e.g., stainless steel generally parallels in opposed relation the inclined inductor surface 218 to thereby allow the inductor 202 to be positioned relatively close to the solidifying ingot cladding metal 18'.

The standard inductor leads 224 are electrically connected to the outer surface of inductor 202. The ends of the inductor 202 and the adjoining surfaces of the leads 224 are electrically separated from one another by a sheet of suitable nonconducting material, such as laminated sheet formed from silicon-bonded fiberglass cloth (not shown). To reduce the magnetic field generated outside the inductor 202, a plurality of vertical grooves can be milled into the outer surface of the inductor.

The shield 222 is supported by a plurality of L-shaped support or bracket members 226 which are associated with height-adjusting threaded posts 228 and adjustment knobs 232 connected to bracket members 226. A coolant chamber 230 within the electromagnetic shield is supplied with coolant from conduits (not shown). The shield is raised or lowered by turning the handles or knobs 232 on the threaded posts 228 which support bracket members 226. The electromagnetic shield allows for a much finer or closer control of the molten metal shape. However, because of the geometry of the inductor that is illustrated and discussed in some detail in U.S. Pat. No. 4,004,631, the electromagnetic shield does not consume the amount of electrical power characterized by the prior art shields.

The inner mold assembly includes the stepped interior water-cooled mold 240 dependently affixed by supporting bracket means 242 from the refractory-lined hot top distributor of molten metal reservoir 244. A refractory feed spout 246 is used to transfer molten cladding metal 18' from the reservoir 244 to the seat portion 248 of mold 240 in a manner similar to the feeding system of the mold assembly of FIG. 1. Interior mold 240 can be equipped with a refractory lining 249 of sufficient thickness to have passageways for directing coolant into and out of the mold coolant chamber 247.

The bottom inside wall 250 of mold 240 is inclined slightly downwardly and inwardly away from the cladding 18' whereby as the cladding solidifies and shrinks or contracts inwardly, there will be sufficient clearance between wall 250 and the cladding for the cladding material to clear wall 250 without binding. A molten metal control system similar to that for the casting station of FIG. 1 can be used with that of FIG. 5 to maintain the desired heads of molten cladding metal 18' and molten core metal 19.

In forming the cladding metal 18' into a tubular mold 18'', the bottom block assembly similar in structure and operation to that of FIG. 1 is raised into position within the peripheral area of inductor 202 and beneath shield 222. High frequency current is supplied to inductor 202 to generate the usual electromagnetic field. Coolant water is allowed to pass out through peripheral sprays 204 as molten metal is introduced to spout 246 and in between shield 222 and inductor 202 and into mold assembly 240 onto the bottom block after a selected length of cladding mold 18'' has been produced. The forces generated by the electromagnetic field immediately begin to shape the molten metal 18' in the desired tubular manner as the casting operation continues. The solidification front or line of the molten metal surface occurs about the midpoint of the inductor 202 as shown and the freezing line slightly higher. From the above, it will be seen that as soon as predetermined initial solidified portions of the cladding shell and mold 18'' move adjacent to the terminal end 260 of mold inductor assembly 200, the flow plug 40 for the spout 264 of transfer trough 266 for the molten metal of the core 19 can be opened and core material fed to the moving mold 18'' formed by the cladding material. As noted, the electrical control means of FIGS. 1–1C can then continue to operate and synchronize the flow of core metal 19 from covered trough 266 and cladding metal 18' from reservoir 244 to assure full solidification of the moving cladding metal 18' prior to contact thereof with the molten metal of core 19. Thereafter the casting operation continues until a clad ingot of the desired size is cast.

From the above, it will be seen that a simplified improved process and system for casting various sizes and shapes of composite ingots, major parts of which comprise normally difficult to cast aluminum-lithium alloys has been disclosed and described.

Although various embodiments of the process and system have been disclosed and described, various changes may be made therein without departing from the spirit and scope thereof as defined in the appended claims wherein what is claimed is:

1. A method of protecting a lithium-containing aluminum alloy from oxidation and other undesirable reactions during casting and subsequent fabrication and processing operations, said method comprising:

(a) forming, in a mold in a continuous or semi-continuous casting apparatus, a hollow, tubular casing of an aluminum alloy containing no more than trace amounts of lithium;

(b) solidifying the aluminum alloy in the casing;

(c) casting into the interior of the casing a core of molten aluminum-lithium alloy containing more than about 0.25% lithium so that the molten aluminum-lithium alloy contacts the casing only after the metal forming the casing has completely soldified;

(d) solidifying the aluminum-lithium alloy core within the casing; and (e) continuously or semi-continuously withdrawing the composite core and casing from the casting apparatus.

2. A method according to claim 1 wherein the solidifying of step (b) is carried out by spraying coolant water on the exterior of the mold in which the casing is formed.

3. A method according to claim 1 wherein the solidifying of step (d) is carried out by spraying coolant water on the exterior of the solidified casing.

4. A method according to claim 3 wherein the solidifying of step (b) is carried out by spraying coolant water on the exterior of the mold in which the casing is formed.

5. A method according to claim 1 wherein the forming of step (a) and the casting of step (c) are controlled so that the difference between the molten metal level in the casing mold and the molten metal level of the aluminum-lithium alloy within the solidified casing is maintained at a constant, predetermined value.

6. Method according to claim 1 wherein the lithium-free aluminum casing alloy has a higher solidus temperature than the lithium-containing aluminum core alloy.

* * * * *